United States Patent [19]

Farnham et al.

[11] Patent Number: 4,581,700

[45] Date of Patent: Apr. 8, 1986

[54] PROCESSING SYSTEM FOR GRADE CROSSING WARNING

[75] Inventors: Wilfred L. Farnham; Lynn R. Garrison, both of Blue Springs; Wayne N. Wheeler, Independence; Forrest H. Ballinger, Grain Valley, all of Mo.

[73] Assignee: SAB Harmon Industries, Inc., Grain Valley, Mo.

[21] Appl. No.: 637,911

[22] Filed: Aug. 6, 1984

Related U.S. Application Data

[63] Continuation of Ser. No. 290,925, Aug. 7, 1981.

[51] Int. Cl.[4] ..... G05B 9/02

[52] U.S. Cl. ..... 364/185; 364/186; 364/436; 246/121; 246/122 R; 246/125; 246/130; 246/34 A; 340/931; 340/938; 340/941

[58] Field of Search ..... 364/184, 185-186, 364/436, 200, 900; 246/125, 130, 34 R, 34 A, 34 CT, 121-122 R; 340/38 L, 931, 938, 941; 371/3, 14

[56] References Cited

U.S. PATENT DOCUMENTS

| | | | |
|---|---|---|---|
| 3,619,604 | 11/1971 | Auer, Jr. | 246/125 |
| 3,740,550 | 6/1973 | Geiger | 246/125 |
| 3,781,543 | 12/1973 | Staples et al. | 246/130 |
| 3,829,682 | 8/1974 | Geiger | 246/125 |
| 3,929,307 | 12/1975 | Geiger | 246/130 |
| 3,963,201 | 6/1976 | Brumberger et al. | 246/34 R |
| 4,052,595 | 10/1977 | Erdmann et al. | 340/38 L |
| 4,115,847 | 9/1978 | Osder et al. | 364/186 |
| 4,172,576 | 10/1979 | Sret, Jr. et al. | 246/125 |
| 4,263,647 | 4/1981 | Merrell et al. | 364/186 |
| 4,287,565 | 9/1981 | Haubner et al. | 364/186 |
| 4,306,694 | 12/1981 | Kuhn | 246/125 |
| 4,307,860 | 12/1981 | Kuhn | 246/125 |
| 4,324,376 | 12/1982 | Kuhn | 246/125 |
| 4,328,583 | 5/1982 | Stodola | 371/3 |
| 4,356,485 | 10/1982 | Boschulte et al. | 340/931 |
| 4,361,301 | 11/1982 | Rush | 246/34 R |
| 4,365,777 | 12/1982 | Geiger | 246/125 |
| 4,369,427 | 1/1983 | Drekinger et al. | 340/38 L |
| 4,383,240 | 5/1983 | Staats, Jr. | 340/931 |
| 4,398,233 | 8/1983 | Bala et al. | 364/186 |
| 4,409,635 | 10/1983 | Kraus | 364/186 |
| 4,468,768 | 8/1984 | Sunkle et al. | 371/3 |
| 4,494,717 | 1/1985 | Corrie et al. | 371/3 |

*Primary Examiner*—Jerry Smith
*Assistant Examiner*—John R. Lastova
*Attorney, Agent, or Firm*—D. A. N. Chase; Michael Yakimo, Jr.

[57] ABSTRACT

A railroad train moving along an approach to a grade crossing (or other location of interest) is detected by apparatus that is responsive to the change in effective track impedance caused by the moving shunt. A constant current AC signal is applied to the track adjacent the crossing, and the resulting voltage changed in amplitude and phase is picked off by a receiver on the opposite side of the crossing. Voltage and current information derived from these signals is inputted to a microcomputer which calculates the track impedance and determines whether or not a warning device or devices at the crossing should be activated. Such determination is made on a repetitive basis in accordance with a repeating program loop and stored in memory. To assure that the system is failsafe, the program loop is interrupted at predetermined intervals and an interrupt service routine checks the memory address at which the determination is stored and causes an independent computer output to change state each time the memory is checked and activation of the warning is not required. Accordingly, the independent output is toggled to produce an AC output signal, the loss of which initiates activation of the warning. The program executes each loop in a fixed time period which is monitored, and if the program is not executed within such period, the system is forced to reset and the warning is activated until the proper time constraints are again met. A self check also assures that the system will respond to the loss of the AC output signal.

5 Claims, 7 Drawing Figures

PROCESSING SYSTEM FOR GRADE CROSSING WARNING

This application is a continuation, of application Ser. No. 290,925 filed Aug. 7, 1981.

This invention relates to improvements in methods and apparatus for detecting a moving railroad train and in predicting the time that will elapse before the train arrives at a grade crossing or other location of interest and, in particular, to a fail-safe microcomputer system which is employed to determine whether or not a warning at the crossing should be activated.

Motion detectors are widely used in railroad grade crossing protection systems to sense an approaching train and activate a warning device or devices at the crossing. Such detectors are responsive to the change in impedance of the railroad track caused by the shunting effect of the wheels of an approaching train. A discussion of the impedance characteristics of a railroad track is contained in Ballinger et al., U.S. Pat. No. 3,838,270, issued Sept. 24, 1974, entitled "Digital Motion Detector," and owned by the assignee herein. In this patent a motion detector is disclosed in which the inductive portion of the track circuit impedance forms a part of the tuning circuit of an oscillator in order to sense the change in inductance and thereby recognize an approaching train. Representative systems which utilize the rails of the track as a transmission medium and apply an alternating current signal to the track are disclosed in U.S. Pat. Nos. 3,850,390, 3,929,307 and 3,987,989, also owned by the assignee herein.

The introduction of the microcomputer now makes it possible in a unit of small size to increase the capabilities and the capacity of electrical equipment, such as grade crossing motion detectors, which are required to perform arithmetic and logic functions. The fact that a microcomputer can be programmed by software is an additional feature that makes the microcomputer especially desirable for applications of this type. It is readily capable, for example, of accurately predicting the time that will elapse before a detected train reaches a protected crossing so that the crossing gate or other warning device will not be activated in response to a slow-moving train until it is at a distance corresponding to a predetermined minimum warning time. However, though advantageous as discussed, the microcomputer must be operated in an entirely fail-safe manner so a computer error or malfunction for whatever reason will cause the system to go into a fail-safe mode, i.e., activate the warning and maintain it activated until the disability is corrected or the crossing is placed under manual control by railroad personnel.

It is, therefore, the primary object of the present invention to provide a method and apparatus for detecting a moving railroad train through the use of a fail-safe digital computer system.

Another important object of this invention is to provide a method and apparatus as aforesaid for detecting an approaching train and determining whether or not a warning should be activated, through the use of a track-side microcomputer which is operated in a manner such that a computer failure results in activation of the warning as if a train were detected.

Still another important object of this invention is to provide a microcomputer as aforesaid which is programmed in a manner to deliver an output signal of special character in the absence of the detection of a train, whereby the loss of such signal indicates an approaching train or a system failure.

A further and important object of this invention is to provide a microcomputer which is operated by a repeating program loop that is monitored so as to force a system reset, and activation of the warning, if each program loop is not executed in a predetermined time period.

Additionally, it is an important object of this invention to provide such a system which is self checking to assure that there will be a response to a loss of the output signal from the computer.

THE MICROCOMPUTER HARDWARE

Figure 1A:
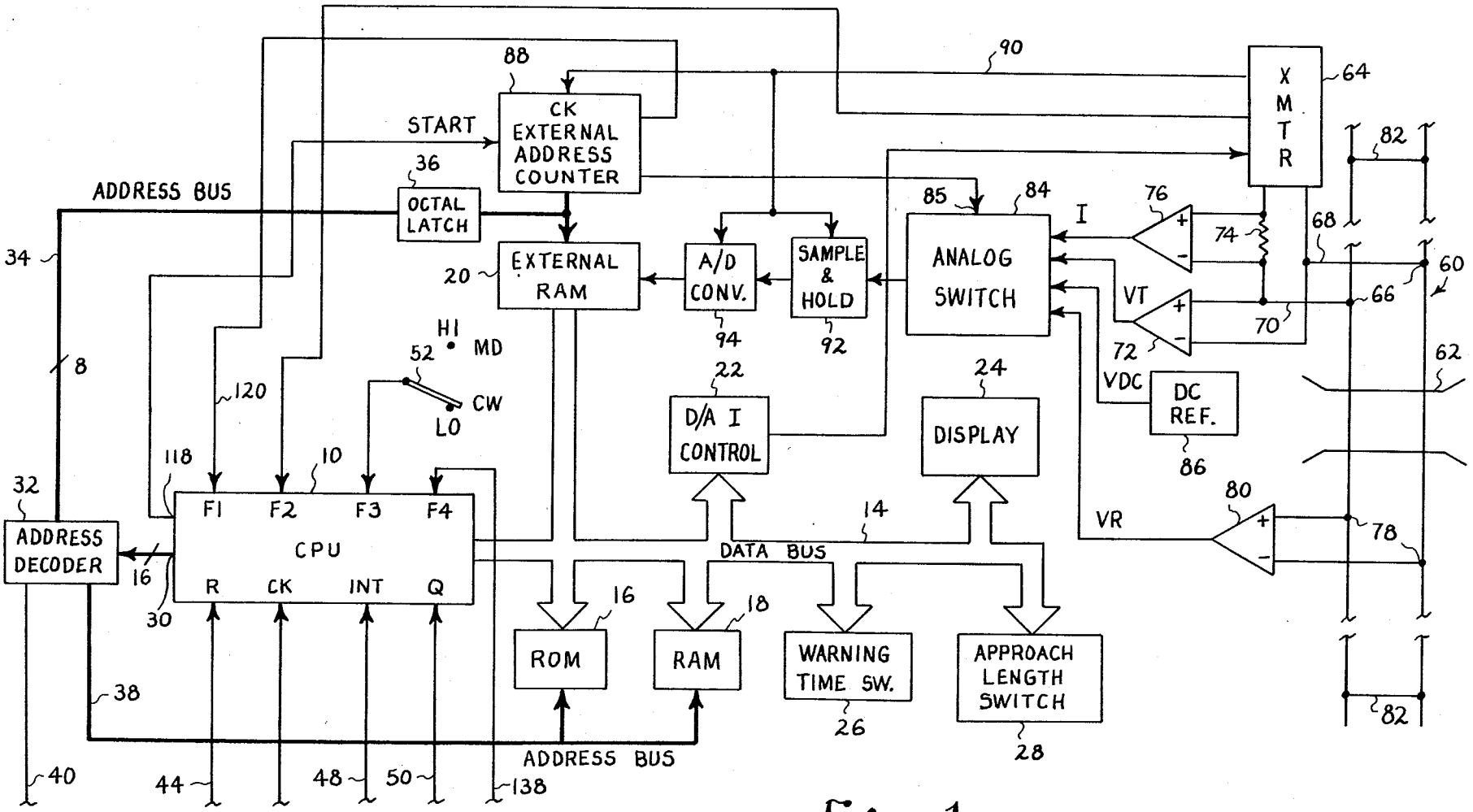
FIGS. 1*a* and 1*b* comprise a block diagram of the motion detection system of the present invention.

Referring to FIG. 1*a* (and FIG. 1*b* as necessary), a central processing unit (CPU) 10 comprises a COSMAC microprocessor such as a commercially available CDP1802 series microprocessor manufactured by RCA Corporation. The RCA-CDP1802 is an LSI COS/MOS 8-bit register-oriented central processing unit designed for use as a general purpose computing or control element in a stored program system. The CPU includes all of the circuits required for fetching, interpreting and executing instructions which have been stored in memory. Accordingly, the CPU includes the usual program counter, instruction decoder, arithmetic logic unit, accumulator, and input/ output (I/0) block.

For convenience of illustration and discussion, the CPU clock is illustrated externally of the CPU 10 and comprises a 3 MHz crystal oscillator 12 having its output connected to a clock input CK of the CPU 10. In addition, the CPU 10 has a reset input R, an interrupt servicing input INT, and an output Q provided by an internal flip-flop. It is to be understood that this internal flip-flop is set or reset by instruction and is independent of the programming that determines whether or not a moving train is on the track, as will be later discussed. Accordingly, the Q output is either at the high or low logic level depending on whether the flip-flop is set or reset.

The application of a high logic level pulse to the INT input forces the microprocessor to jump to a predetermined address in the program memory and execute in accordance with the machine code instructions there. The utilization in the present invention of the interrupt servicing function will be described hereinbelow.

The CPU 10 also has four flag inputs F1, F2, F3 and F4. The program instructs the microprocessor to test these flag inputs at various times for purposes to be discussed.

An 8-bit bidirectional data bus 14 connects the CPU 10 with a read-only memory (ROM) 16 in which the program is stored, a random access memory (RAM) 18 and the following external devices: an external RAM 20, a digital-to-analog current control 22, a numeric display 24, a warning time switch 26 and an approach length switch 28. Details of the logic interfacing with the data bus are not shown. The display 24 would typically be on the front panel of the trackside unit and the warning time and approach length switches 26 and 28 would likewise be controlled from the front panel. By way of example, if the approach length to a grade crossing is 3000 feet and the desired warning time is 25 seconds, these numbers would be set into the switches 28 and 26 respectively and would be represented on the data bus 14 in binary coded decimal form.

A 16-line address bus extends from the address output 30 of the CPU 10 to an address decoder 32, from which an address bus 34 extends to an octal latch 36 and then to the external RAM 20. Also, an address bus 38 extends from the address decoder 32 to the ROM 16 and RAM 18. In addition to addressing the memories 16, 18 and 20 in accordance with address information from the CPU 10, the decoder 32 produces a stall timer pulse along an output line 40 at the end of each program loop. This pulse is delivered to the control input of a stall timer 42 which is a retriggerable one shot that requires a periodic pulse at its control input in order for its output to remain at a high logic level so that, via line 44, the reset input R of the CPU 10 will likewise remain high. If the CPU loses track of the sequential instructions stored in the ROM 16, the timer 42 will time out and its output will go low to cause a reset to the beginning of the program.

In addition to providing a 3 MHz clock to the CPU 10, the output of the oscillator 12 is also fed to a divide-by-10,714 network 46, resulting in a signal at the output of network 46 (on line 48) having a frequency of 280 Hz. The network 46 may comprise a presettable countdown timer with an automatic reset; therefore, the 280 Hz signal is continuously applied to the INT input of the CPU 10.

As will be subsequently explained, under normal conditions (crossing warning inactivated) a 140 Hz square wave output signal is present on a line 50 extending from the Q output of the CPU 10 to circuitry to be described. Loss of this 140 Hz signal, which may be occasioned by detection of a moving train or a system failure, initiates the activation of the grade crossing warning.

A single pole selector switch 52 is connected to the flag input F3 and permits two modes of operation. When the movable pole is closed against its upper contact (maintained at the high logic level) the system operates solely as a motion detector and will activate the warning whenever a moving train is detected. In the position shown closed against its lower contact (maintained at the low logic level), the system is in a predict or constant warning time mode and the warning is not activated until the computer predicts that the train will arrive at the crossing within the time set by the warning time switch 26.

TRACK SIGNAL SAMPLING

Referring to FIG. 1*a*, the rails of a railroad track 60 are diagrammatically illustrated forming an intersection with a road 62 at a grade crossing which is protected by suitable warning devices (not shown). A transmitter-controller 64 produces a constant current, sinusoidal signal which is applied to the rails at a connection point provided by a pair of tie points 66 to which the output leads 68 and 70 from the transmitter are connected. The frequency of the transmitted signal is selected for a given site in accordance with interference considerations, and may be generally in the audio frequency range of 100 to 1000 Hz. A differential input amplifier 72 has its noninverting input connected to lead 70 and its inverting input connected to lead 68, the output thereof providing a voltage VT representing the voltage of the transmitted signal across the tie points 66. A precision resistor 74 is interposed in series with output lead 70, and a differential input amplifier 76 has its inputs connected to the respective ends of resistor 74 in order to provide an output signal I representative of the value of the constant current applied to the track.

On the opposite side of the crossing, the track signal is picked off at a pair of tie points 78 by a receiver which is another differential input amplifier 80 having its inputs connected to the respective tie points 78. The output signal VR from amplifier 80 is a voltage representative of the received signal at the tie points 78 which, of course, is of decreased amplitude and is shifted in phase relative to the initial transmitted signal at tie points 66 due to the resistance and inductive reactance presented by the interconnecting track. Although not shown, amplifier 80 is preferably provided with a gain control interfaced with the data bus 14.

The tie points 66 and 78 are located adjacent the crossing and define the "island" therebetween. A separate AC overlay island circuit (not shown) has its own transmitter and receiver and is used to detect train presence at the grade crossing and control the warning devices. When any set of wheels of a train is within the island, the island receiver responds and assures that the crossing warning is in operation. The present invention, however, is concerned only with the approaches to the island which extend in each direction a distance typically of from 500 to 3000 feet. Terminating shunts 82 across the rails define the remote ends of the approaches.

An analog switch 84 has four inputs receiving the track signals I, VT and VR respectively plus a direct current reference voltage VDC from a potentiometer 86. The reference potentiometer 86 is used to adjust the current of the transmitted signal to the track by setting the voltage VR at the proper level at the receiver with no train present. An external address counter 88 has a clock input CK which receives sampling pulses from a line 90 extending from the transmitter-controller 64. Likewise, a sample and hold circuit 92 and an analog-to-digital converter 94 are under the control of the sampling pulses on line 90 to be discussed more fully hereinbelow with reference to the details of the transmitter-controller set forth in FIG. 2.

Figure 3:
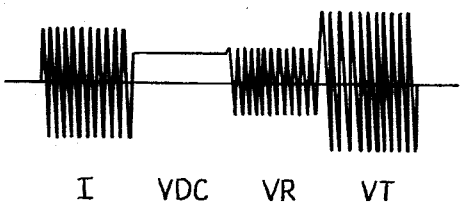
FIG. 3 is a wave form diagram showing the multiplexed signals at the output of the analog switch.

The function of the analog switch 84 is to multiplex the four input signals and present them to the sample and hold circuit 92. This is time domain multiplexing as illustrated in FIG. 3 which shows the output of the analog switch 84 that is delivered to the sample and hold circuit 92. Note that the four signals I, VDC, VR and VT in one complete cycle of the analog switch 84 appear sequentially at the switch output and each occupies one-fourth of the total cycle time. Cycling is accomplished on command from the address counter 88 to the control input 85 of analog switch 84 to synchronize the stepping of the switch with the addressing of the external RAM 20.

The sample and hold circuit 92 samples eight data points on each of the four signals during a half-cycle period, i.e., a period equal to a half cycle of I, VR and VT which are all of the same frequency. Sixty-four data points for each signal consisting of eight successive half-cycle periods are stored in the external RAM 20 after being converted to digital values by the analog-to-digital converter 94. These eight, half-cycle data groups are subsequently averaged by a digital filtering algorithm (CURVFT routine) and used by the microprocessor in the amplitude and phase computations.

Figure 4:
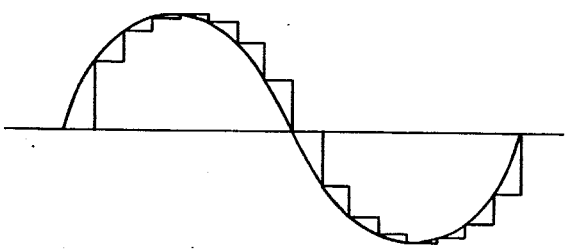
FIG. 4 shows superimposed wave forms illustrating the operation of the sample-and-hold circuit in response to the sampling pulses.

The action of the sample and hold circuit 92 is illustrated in FIG. 4. The sine wave is illustrative of either of the signals I, VT or VR. The output of the circuit 92 is represented by the eight steps in amplitude, up and down, occurring in each half cycle. In response to the direct current voltage VDC, the output from circuit 92 is, of course, an unchanging level.

Figure 2:
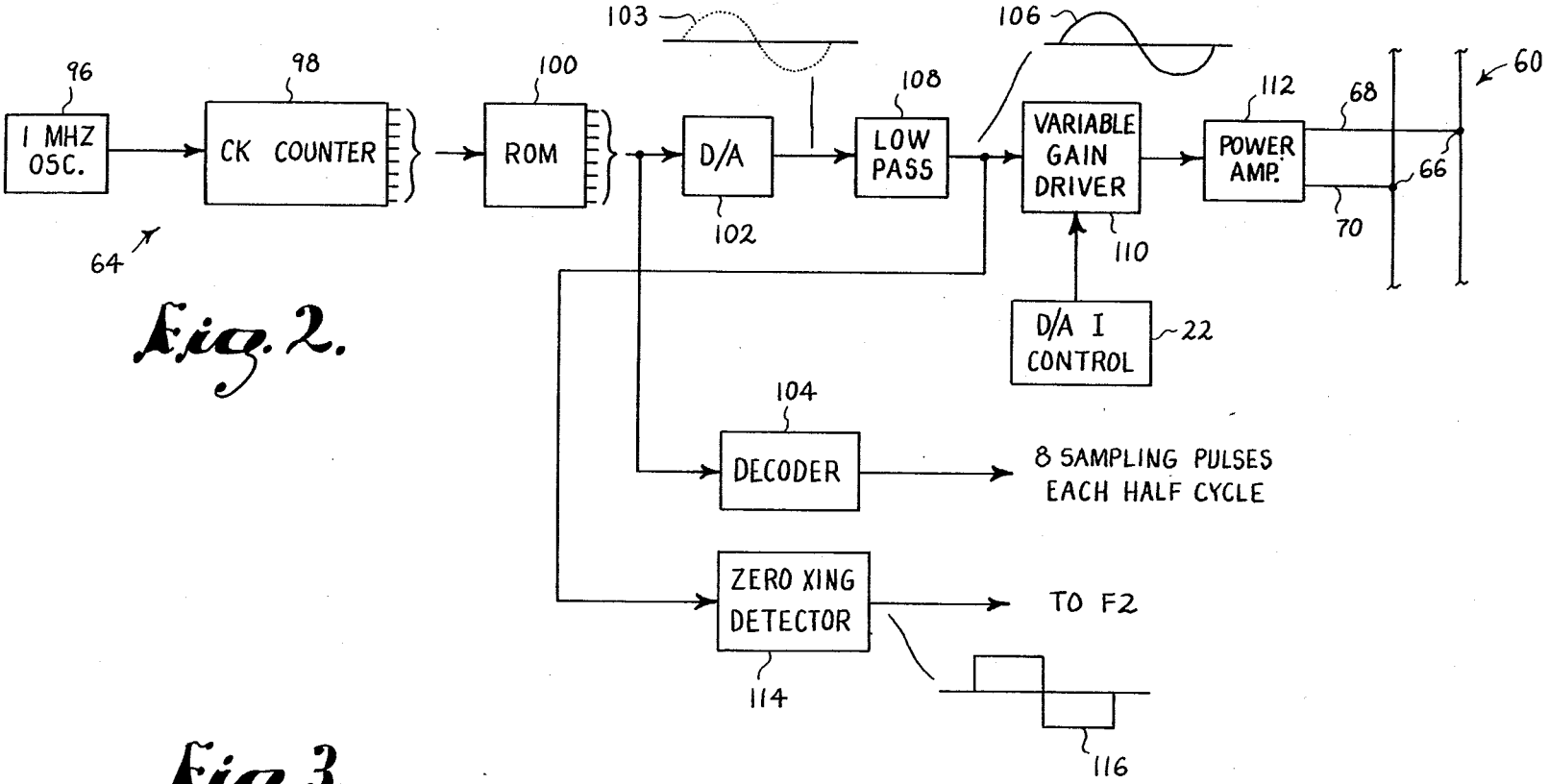
FIG. 2 is a block diagram showing the details of the transmitter-controller.

Details of the transmitter-controller 64 are seen in FIG. 2. A 1 MHz oscillator 96 drives the clock input CK of a programmable counter 98 having, for example, an output consisting of eight address lines connected to the address input of a read only memory (ROM) 100. Eight data lines from the ROM 100 extend to a digital-to-analog converter 102 and to a decoder 104 that decodes specific digital values from the ROM 100 representing an interval of 22½ degrees of the track signal frequency (one-eighth of a half cycle). The output of the digital-to-analog converter 102 is illustrated at 103 and comprises a multitude of discrete voltage levels that trace a sine wave, due to the programming of the ROM 100. Accordingly, the circuitry comprises a digital sine wave oscillator with such sine wave (illustrated at 106) being formed by passage of the output of the converter 102 through a low-pass filter 108.

The oscillator output comprising sine wave 106 at the desired audio frequency is fed to a variable gain driver stage 110 that precedes a final power amplifier 112 which is transformer-coupled to the tie points 66 on the rails. The digital-to-analog current control 22 controls the gain of the driver stage 110 in accordance with information on the data bus 14 (FIG. 1*a*) to set the track current level.

A zero crossing detector 114 also receives the sine wave output 106 of the digital oscillator and converts such wave into a square wave illustrated at 116 in FIG. 2. This square wave 116, which is at the same frequency as the sine wave 106, is inputed to the CPU 10 at the flag input F2.

The CPU 10 (FIG. 1*a*) has an external address counter enable output 118 connected to the external address counter 88 for the purpose of starting the counter 88 at the appropriate times during the program loop. A line 120 connects the counter 88 to flag input F1 and goes high once the counter 88 has counted up and stopped.

WARNING ACTIVATION CIRCUITRY

Figure 1B:
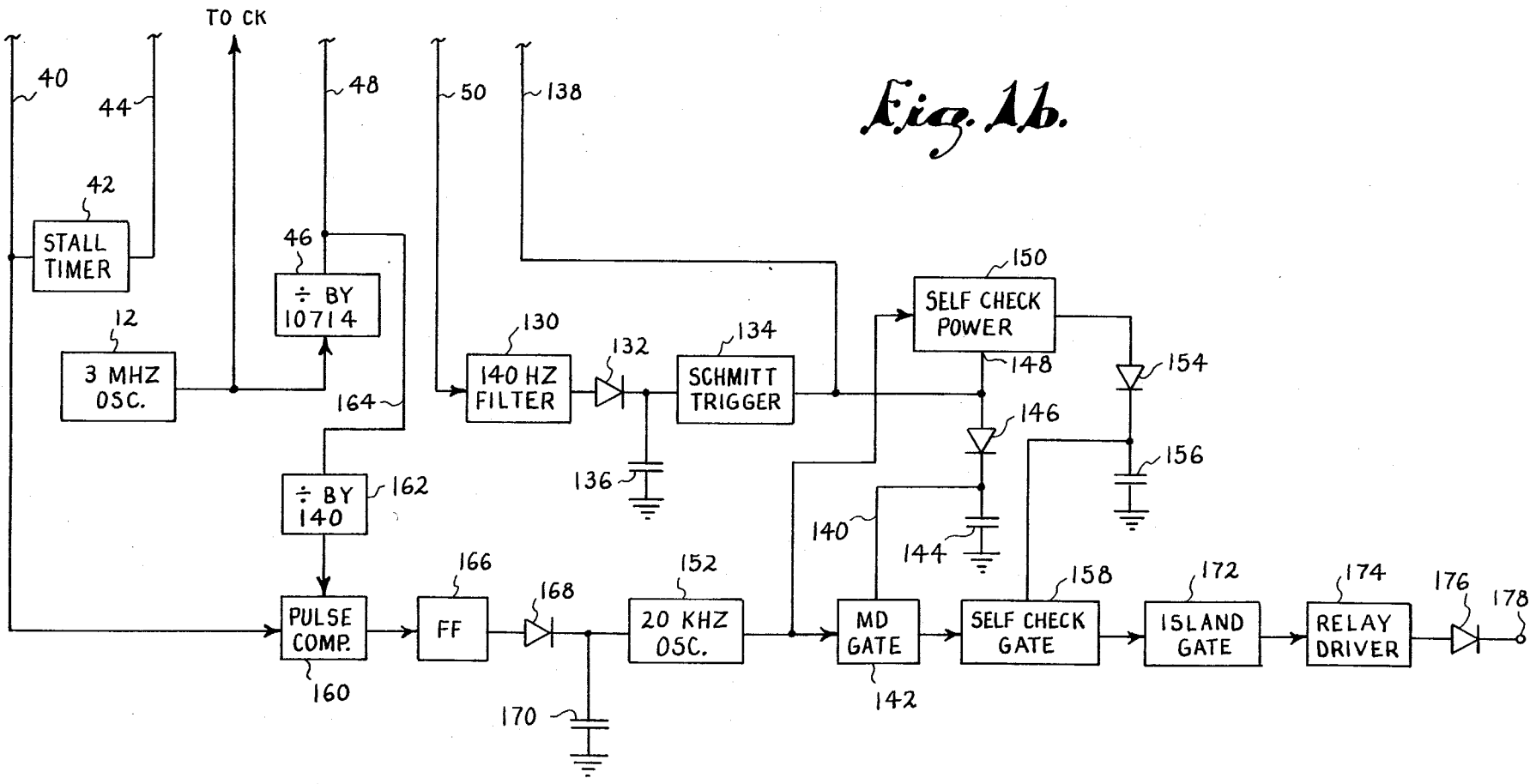

Referring primarily to FIG. 1*b*, the output signal from the CPU 10 on line 50 (produced when the system is not in detection) is a 140 Hz square wave which is fed to a bandpass filter 130 and then rectified by a series diode 132 and fed to the input of a Schmitt trigger 134. A capacitor 136 across the input of the Schmitt trigger maintains its output at the high logic level during the omitted half cycle. The output of the Schmitt trigger 134 is connected to the flag input F4 of the CPU 10 by a lead 138, and provides operating voltage on a lead 140 for a motion detector gate 142. A capacitor 144 is connected from lead 140 to circuit ground in order to provide a one-half second delay on the dropout of gate 142, as will be subsequently explained. A diode 146 interposed in series with the power lead 140 isolates the discharge path of the capacitor 144 from the Schmitt trigger output and from the control input 148 of a self-check power gate 150.

The power gate 150 conducts only when the output of the Schmitt trigger 134 goes low, which will occur every four seconds for a period of approximately 200 millisec. This four second interval is generated in software by the QDRIVE routine to be discussed below. During the brief conduction interval, the power gate 150 conducts a 20 KHz signal from an oscillator 152, which is rectified by a diode 154 and charges a capacitor 156 to supply operating voltage to a self-check gate 158. The accumulated charge on the capacitor 156 maintains the self-check gate 158 in conduction during the four second interval that the power gate 150 is not conducting.

A pulse comparator 160 has a pair of inputs, one of which receives the stall timer pulse on line 40 from address decoder 32. The other input receives one pulse every half second from a divide-by-140 network 162. A lead 164 extends from the divide-by-10,714 network 46 to the divide-by-140 network 162, which may comprise a presettable countdown counter with an automatic reset. In this manner, the pulse repetition rate is reduced to one pulse per half second in order to provide a 3.6 millisec. window every half second. If the stall timer pulse coincides with this window, the comparator 160 clocks a flip-flop 166 which will then output a 1 Hz square wave. A series rectifier 168 and parallel capacitor 170 converts the square wave to a direct current to provide power for the 20 KHz oscillator 152.

The output of the self-check gate 158 is connected to an island gate 172 which, in turn, is connected to a relay driver amplifier 174. If the system continues to self-check properly, the 20 KHz signal is passed through the self-check gate 158 and the island gate 172 (when island voltage is present) and is amplified by the relay driver 174, and then rectified by diode 176 to provide a DC voltage at terminal 178 which energizes a relay (not shown) that maintains the grade crossing warning deactivated. (The island circuit opens the circuit through the island gate 172 when a train is present in the island, thereby stopping the 20 KHz signal and causing the relay to drop out and activate the warning.)

In normal operation of the system under instruction from the interrupt service (QTOG) routine to be described hereinbelow, the Q output of the CPU 10 is toggled at a rate of 280 times per second to provide the 140 Hz square wave output signal. However, when the unit goes into detection, the Q output remains at one state (either the high or the low logic level) and excitation is removed from the Schmitt trigger 134. The output of the trigger 134 will go low and, in approximately one-half second, capacitor 144 will discharge and the motion detection gate 142 will cease conduction of the 20 KHz signal. This deenergizes the warning relay to activate the warning system.

The purpose of the self-check gate 158 is to be certain that the activation circuitry will properly respond to loss of the 140 Hz output signal. The self-check is accomplished by purposely briefly removing the 140 Hz signal every four seconds as set forth above. If the output of the Schmitt trigger 134 fails to go low, the power gate 150 will not conduct and, therefore, the capacitor 156 will be permitted to discharge and the self-check gate 158 will cease to conduct the 20 KHz signal from oscillator 152. Therefore, the warning is activated until the disability is corrected or the crossing is placed under manual control by railroad personnel.

Furthermore, the 20 KHz signal also stops if the program fails to execute a loop. As will be discussed hereinbelow, the program executes a loop in one-half second and thus the appearance of a stall timer pulse on line 40 every half second during a corresponding 3.6 millisec. window in comparator 160 is required in order to clock the flip-flop 166.

THE SOFTWARE

The ROM 16 contains the program for the microcomputer. The program of the present invention is cyclical in nature and executes a loop in a fixed time period which, in the disclosed embodiment as mentioned above, is one-half second (500 millisec.). The loop is executed in one-half second regardless of branches in the program. Any deviation from this loop time, as detected by the stall timer 42 or the pulse comparator 160, is interpreted as a system failure and the warning is activated until the proper time constraints are again met.

Figure 5:
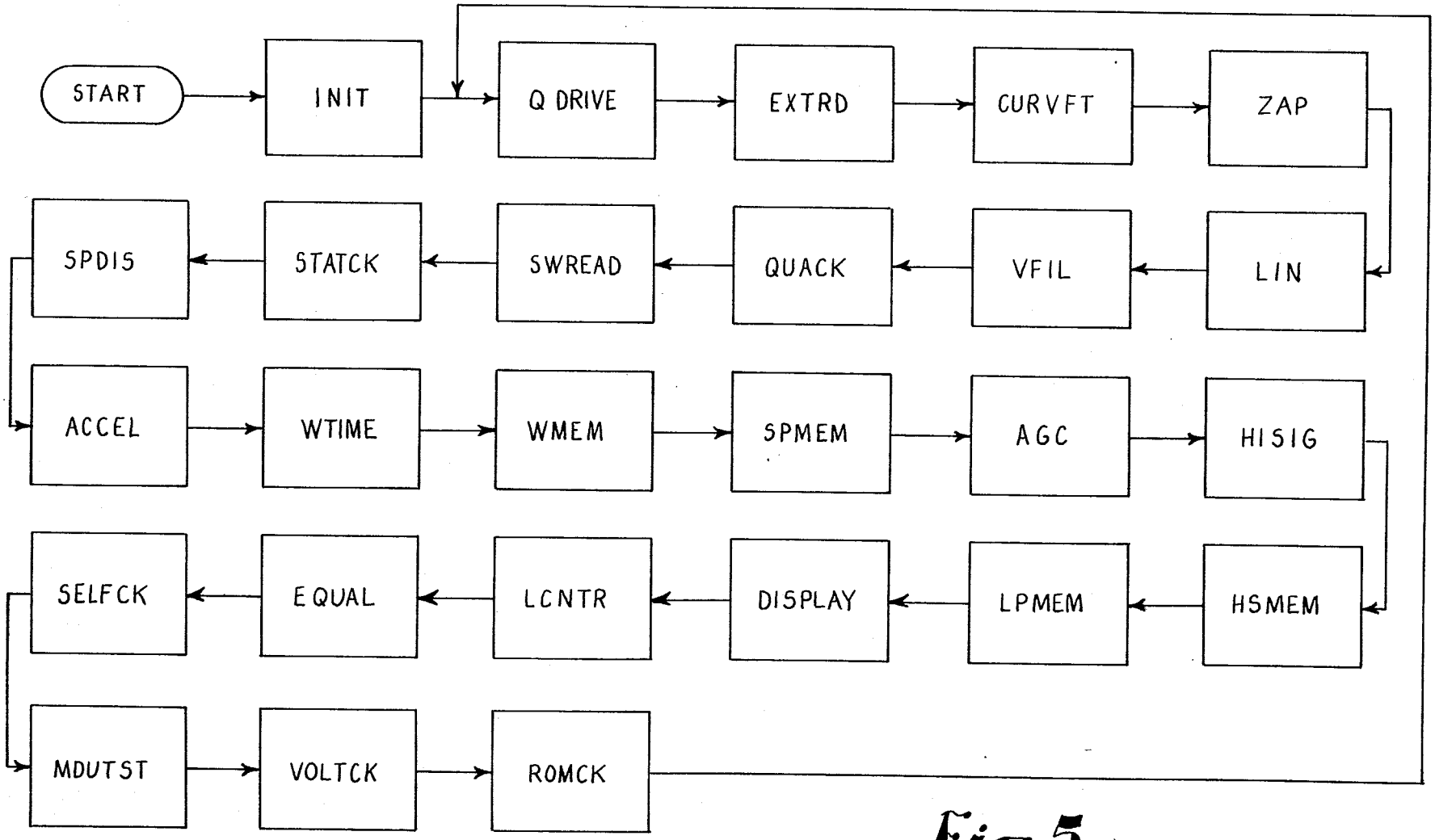
FIG. 5 is a general program flowchart identifying each routine of the program loop.

FIG. 5 is a flowchart that identifies each routine of the program loop. The routines are described as follows.

INIT (initialization) routine: This routine is entered upon either of (1) power on, (2) manual reset on CPU board, or (3) an error occurrence. Its purpose is to initialize the internal registers in the CPU 10 for proper subroutine calling, to initialize certain RAM locations with proper data and to force the unit into detection for approximately 20 seconds (until the software LOS (loss of shunt) timer counts out). It also tests the F2 input and determines the frequency that the unit is operating at and checks to make certain that it is an allowable frequency. Pertinent information about the frequency (i.e., 22.5 degrees/sample) is stored in both true and complement values in RAM 18. The routine also checks to make certain that the analog switch multiplexer 84 has the proper beginning input selected before the routine passes control to the QDRIVE routine.

QDRIVE routine: This routine checks to see if a self-check cycle for the motion detector relay drive circuit (Schmitt trigger 134 through output terminal 178) is supposed to occur in the current program loop, and if so, and the unit is not in detection, disables the Q output so it cannot be toggled. If the unit is in detection, the routine does nothing.

EXTRD (external read) routine: This routine inputs data from the external RAM 20 and stores this data in system RAM 18. It then checks to make certain that the analog switch multiplexer 84 has the proper beginning input selected and restarts the external address counter 88.

CURVFT (curve fitting) routine: This routine performs a digital filtering algorithm on the digital data read into system RAM 18 by the EXTRD routine and does checks as desired by the programmer to make sure the data is valid.

ZAP (impedance and phase) routine: This routine takes data from CURVFT, after the digital filtering has been performed, and calculates the phase and amplitude of the signals (VT, I and VR) from the track. (These values are used by later routines to determine the speed and distance of a train on the approach.)

LIN (linearization) routine: This routine takes phase and amplitude from the ZAP routine and produces a digital value $V_L$ which is linearly proportional to the distance of the train shunt from the transmitter tie points 66. An appropriate curve fitting algorithm is used.

VFIL ($V_L$ filter) routine: This routine performs in software a low pass filtering of the $V_L$ values generated by the LIN routine in order to smooth out response of the unit and aid in handling transients that occur from noise on the track, etc.

QUACK routine: This routine is part of a self-check of the Q output to be certain that it is under computer control. If the Q output were disabled in QDRIVE routine, the QUACK routine checks to make certain the Q output is disabled and, if not, an error is generated. If the test is passed, then the QUACK routine restores the Q output and the program continues to the next routine.

SWREAD (switch read) routine: This routine reads in data from front panel switches (warning time and approach length switches 26 and 28), and programming switches such as MD/CW switch 52, checks switch integrity and stores the switch values in RAM 18 as true numbers and complement numbers.

STATCK (status check) routine: This routine monitors various status indications generated by the CURVFT and ZAP routines, analyzes them and generates an error if conditions are not as they should be.

SPDIS (speed-distance) routine: This routine uses $V_L$ values generated by the LIN routine and track length value from the SWREAD routine to determine the distance from the island to a shunt on the tracks. From successive distance calculations and knowing the loop time of the program, the speed at which a shunt is approaching the island is calculated.

ACCEL (acceleration) routine: This routine uses successive speed results from the SPDIS routine to determine the acceleration of a shunt towards the island.

WTIME (warning time) routine: This routine takes speed and distance information from the SPDIS routine, and acceleration information from the ACCEL routine and determines the time it will take for a moving shunt to reach the island of the crossing. Based on the setting of the MD/CW switch 52, the unit either performs as a conventional motion detector or strives to maintain a constant warning time (time the warning system is activated) before a train arrives at the crossing. The warning time switch 26 on the front panel is used to set the desired warning time. Once the unit in the constant warning time mode determines that the warning should be activated, the unit reverts to a motion detection mode until the train is in the island area. When a warning determination is made, the detection bit(s) is set into a dedicated address(es) in the RAM 18. Simultaneously, the routine initiates the loss of shunt (LOS) timer at 20 seconds (40 program loops) and retains this value in the RAM 18. Upon loss of the detection bit, the value is decremented on each repeating loop until the time is reduced to zero or the timer is cleared for other reasons. Also, this routine monitors the island so that whenever a train is in the island area, the unit is in detection. When a train leaves the island area, and the routine verifies that the train is outbound, the LOS timer and the warning system are cleared.

WMEM (warning time memory) routine: This routine stores the warning time of the last train detected that made an island passage. This value is stored in RAM 18 for display on the local display panel.

SPMEM (speed memory) routine: This routine stores the average speed and island speed of the last train detected that made an island passage. These values are stored in RAM 18 for display on the local display.

AGC (automatic gain control) routine: This routine monitors the levels of receiver and transmitter voltages and adjusts the variable gain driver 110 and the gain of the receiver amplifier 80 accordingly so that the unit is operating within the correct limits of these levels.

HISIG (high signal) routine: This routine monitors the $V_L$ values and, if the value exceeds 15 percent more than its nominal value, it sets a high signal indicator and actuates the warning system, and sets the loss of shunt (LOS) timer.

HSMEM (highest signal memory) routine: This routine stores the highest stable value of RX ($V_L$/128) that the unit has seen since the last reset and stores the phase of VR that corresponded to the RX value stored.

LPMEM (low phase memory) routine: This routine stores the lowest stable value of phase of VR that the unit has seen since the last reset and stores the RX ($V_L$/128) that corresponded to the phase value stored.

DISPLAY routine: This routine displays pertinent data on the front panel display 24 as desired, such as:

RX ($V_L$/128)
PHASE
WT (warning time)
TS (train speed)
HS (highest signal)
LP (lowest phase)

LCNTR (loop counter) routine: This routine increments a counter every time the program runs through its loop. (This value is used other places in the main routines to aid in determining status of the unit.)

EQUAL (equalization) routine: This routine is used to provide a fixed delay for equalizing the loop time of the program to a nominal value of 500 milliseconds.

SELFCK (self check) routine: This routine handles some of the self diagnostics the unit performs on itself. MDUTST (multiply-divide unit test), VOLTCK (voltage check) and ROMCK (ROM check) routines are part of SELFCK.

Several standard subroutines are also employed and are described as follows.

LZBLK (leading zero blank) subroutine: This routine blanks leading zero's for the local display 24.

SQRT (square root) subroutine: This subroutine finds the square root of a 2-byte binary number.

IGSET (current set) subroutine: This subroutine is called by the AGC routine and is actually a part of that routine. It sets output drive current of the variable gain driver 110.

ERROR subroutine: This subroutine is called by any main routine or subroutine that detects an error in operation of the unit. ERROR sets up the loss of shunt timer at 20 seconds, activates the warning system by setting the detection bit into the RAM 18, and displays an error code on the local display panel. Program control is passed to the INIT routine.

MATH subroutine package: This package includes a 2 byte by 2 byte add function, a 2 by 2 subtract function, a 2 by 2 multiply function, and a 4 by 2 divide function.

BCDB (binary coded decimal to binary) subroutine: This subroutine converts a number from a binary coded decimal format to a binary format.

BINB (binary to BCD) subroutine: This subroutine converts a number from binary format to binary coded decimal format.

BCD7SG (binary coded decimal to 7-segment) subroutine: This subroutine converts a number from binary coded decimal format to 7-segment format for output on the local display 24.

SCR (standard call and return) subroutine: This subroutine is used to call other subroutines and to return from the called subroutine to the calling program.

DELAY subroutine: This subroutine provides a delay based on a value passed on by the calling routine.

Figure 6:
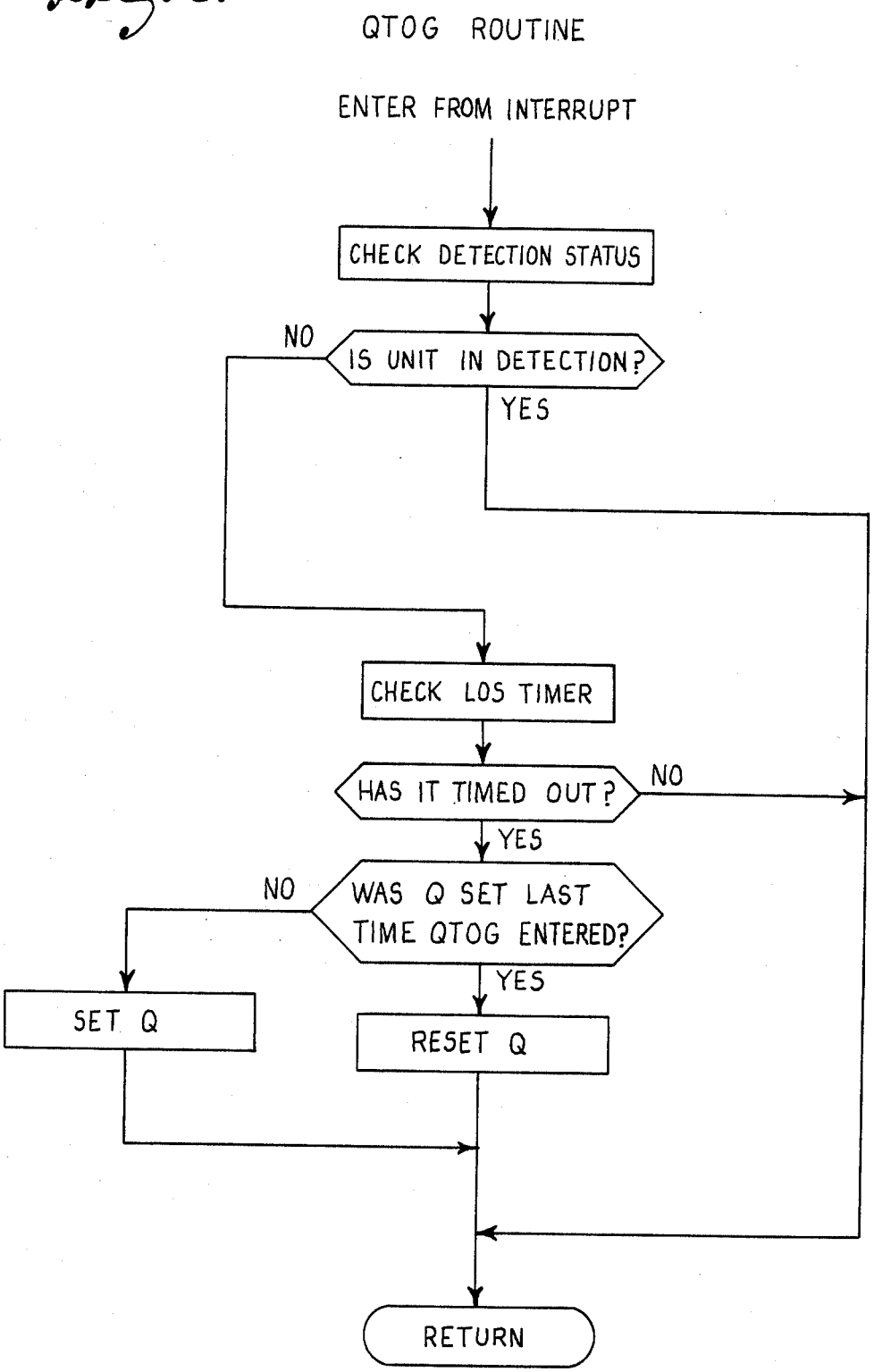
FIG. 6 is a flowchart of the interrupt service (QTOG) routine.

The structure of the interrupt service (QTOG) routine is represented by the flowchart shown in FIG. 6. The QTOG routine is entered in response to the application of a pulse to the INT input, which occurs 280 times per second. Following the flowchart, the computer first checks the detection status by reading the value from the dedicated address or addresses in RAM 18; the presence of the detection bit(s) corresponds to the detection of motion requiring activation of the warning and the absence thereof corresponds to no such detection. If the unit is in detection as thus defined, the computer returns to the regular program loop. If the unit is not in detection, the loss-of-shunt timer is checked and, if it is timed out, the Q output is reset if previously set or set if previously reset, and control is returned to the regular program loop. If the loss-of-shunt timer has not timed out, control is returned directly to the program loop. Accordingly, if the unit is not in detection and the loss-of-shunt timer has timed out, the Q output will be toggled at a rate of 280 times per second to thereby produce the 140 Hz square wave output signal.

It should be understood that the number of times that the program loop is interrupted per second is not critical but is selected in accordance with the audio toggle frequency desired to be handled by the subsequent circuitry. Execution time of the QTOG routine is less than 1 millisecond.

Having thus described the invention, what is claimed as new and desired to be secured by Letters Patent is:

1. A method of operating a digital computer in a fail-safe manner in order to activate a warning device when a train on a railroad track is moving along an approach to a given location, said method comprising the steps of:

deriving information indicative of the impedance of said track adjacent said location and inputing said information to said computer;

providing said computer with a repeating program loop that causes the computer on each program repetition to determine from said information whether or not activation of the warning device is required and to retain such determination in a memory;

repetitively interrupting said program loop to enter an interrupt program which checks said determination in memory and (1) if activation of the warning device is not required, causes an output of said computer to undergo a change of state and then returns control of the computer to said program loop, or (2) if activation of the warning device is required, returns control of the computer to said program loop without altering the previous state of said output, whereby said output repeatedly changes state until activation of the warning device is required or a system failure disables the computer;

sensing the condition of said output to maintain said warning device deactivated in response to repeated changes of the state of said output, and activating said warning device with electrically responsive activating means when the state of said output remains constant for a predetermined period of time;

periodically momentarily disabling said output so its state cannot change;

checking the operability of said activating means in response to said momentary disability; and activating said warning device if the activating means fails to respond to said momentary disability.

2. The method as claimed in claim 1, further comprising the steps of:

monitoring the execution time of said repeating program loop; and activating said warning device if each execution is not completed in a predetermined time period.

3. A method of operating a digital computer in a fail-safe manner in order to activate a warning device when a train on a railroad track is moving along an approach to a given location, said method comprising the steps of:

deriving information indicative of the impedance of said track adjacent said location and inputing said information to said computer;

providing said computer with a repeating program loop that causes the computer on each program repetition to determine from said information whether or not activation of the warning device is required and to retain such determination in a memory;

repetitively interrupting said program loop to enter an interrupt program which checks said determination in memory and (1) if activation of the warning device is not required, causes an output of said computer to undergo a change of state and then returns control of the computer to said program loop, or (2) if activation of the warning device is required, returns control of the computer to said program loop without altering the previous state of said output, whereby said output repeatedly changes state until activation of the warning device is required or a system failure disables the computer;

inputing said computer output to a filter which blocks signals other than those having a time-varying characteristic, whereby an output signal is delivered by said filter only when said computer output repeatedly changes state; and activating said warning device in response to an absence of the output signal from said filter.

4. A method of operating a digital computer in a fail-safe manner in order to activate a warning device when a train on a railroad track is moving along an approach to a given location, said method comprising the steps of:

deriving information indicative of the impedance of said track adjacent said location and inputing said information to said computer;

providing said computer with a repeating program loop that causes the computer on each program repetition to determine from said information whether or not activation of the warning device is required and to retain such determination in a memory;

repetitively interrupting said program loop to enter an interrupt program which checks said determination in memory and (1) if activation of the warning device is not required, causes an output of said computer to undergo a change of state and then returns control of the computer to said program loop, or (2) if activation of the warning device is required, returns control of the computer to said program loop without altering the previous state of said output, whereby said output repeatedly changes state until activation of the warning device is required or a system failure disables the computer;

sensing the condition of said output to maintain said warning device deactivated in response to repeated changes of the state of said output, and activating said warning device with electrically responsive activating means when the state of said output remains constant for a predetermined period of time;

providing said program loop with a routine that periodically momentarily disables said output so its state cannot change;

checking the operability of said activating means in response to said momentary disability; and activating said warning device if the activating means fails to respond to said momentary disability.

5. A method of operating a digital computer in a fail-safe manner in order to activate a warning device when a train on a railroad track is moving along an approach to a given location, said method comprising the steps of:

deriving information indicative of the impedance of said track adjacent said location and inputing said information to said computer;

providing said computer with a repeating program loop that causes the computer on each program repetition to determine from said information whether or not activation of the warning device is required and to retain such determination in a memory;

repetitively interrupting said program loop to enter an interrupt program which checks said determination in memory and (1) if activation of the warning device is not required, causes an output of said computer to undergo a change of state and then returns control of the computer to said program loop, or (2) if activation of the warning device is required, returns control of the computer to said program loop without altering the previous state of said output, whereby said output repeatedly changes state until activation of the warning device is required or a system failure disables the computer;

sensing the condition of said output to maintain said warning device deactivated in response to repeated changes of the state of said output, and activating said warning device when the state of said output remains constant for a predetermined period of time, said activating of the warning device being effected by control means responsive to the presence or absence of electrical excitation;

providing said program loop with a routine that periodically momentarily disables said output so its state cannot change;

interposing a motion detector gate between a source of said electrical excitation and said control means;

maintaining said motion detector gate in conduction so long as said output repeatedly changes state;

providing a self-check gate in series with said motion detector gate between said source and said control means;

in response to each momentary disability of said output, maintaining said self-check gate in conduction for a limited time period greater than the interval from one momentary disability to the next; and holding said motion detector gate in conduction during said momentary disability, whereby both of said gates remain in conduction upon proper response to said disability, whereas failure to so respond causes said self-check gate to cease conduction and remove excitation from said control means to activate said warning device.

* * * * *